United States Patent [19]

Smith

[11] 4,434,014

[45] Feb. 28, 1984

[54] HIGH STRENGTH WEAR RESISTANT ALUMINIUM ALLOYS AND PROCESS

[75] Inventor: David M. Smith, Hawthorn East, Australia

[73] Assignee: Comalco Limited, Victoria, Australia

[21] Appl. No.: 299,176

[22] Filed: Sep. 3, 1981

[30] Foreign Application Priority Data

Sep. 10, 1980 [AU] Australia ..... 5505/80

[51] Int. Cl.[3] ..... C22F 1/04; C22C 21/04

[52] U.S. Cl. ..... 148/3; 148/159; 148/404; 148/417; 420/535

[58] Field of Search ..... 75/142, 143, 144, 147, 75/148; 148/3, 159, 32, 32.5

[56] References Cited

U.S. PATENT DOCUMENTS 2,357,450 9/1944 Bonsack ..... 75/142

4,068,645 1/1978 Jenkinson ..... 75/142

*Primary Examiner*—R. Dean

*Attorney, Agent, or Firm*—Larson and Taylor

[57] ABSTRACT

Aluminium-silicon alloys of the following composition by weight:-

| | Percent |
|---|---|
| Si | 12–15 |
| Cu | 1.5–5.5 |
| | preferably 1.5–4 |
| Ni | 1.0–3.0 |
| Mg | 0.1–1.0 |
| | preferably 0.4–1.0 |
| Fe | 0.1–1.0 |
| | preferably 0.1–0.5 |
| Mn | 0.1–0.8 |
| Zr | 0.01–0.1 |
| Modifier (preferably Sr) | 0.001–0.1 |
| | preferably 0.01–0.05 |
| Ti | 0.01–0.1 |
| Al | Remainder, apart from impurities. |

Superior properties are obtained by control of growth rate of the solid phase during solidification and the temperature gradient at the solid-liquid interface. The alloys of the invention are suitable for a wide variety of applications, including brake calipers and drums, piston/bore applications in internal combustion engines and a number of other components in engines, compressors and electric motors. A particular application of the alloys of the invention is in aluminium cylinder heads.

12 Claims, 12 Drawing Figures a b c

HORIZONTAL MAG. = 100 VERTICAL MAG. = 1000

HIGH STRENGTH WEAR RESISTANT ALUMINIUM ALLOYS AND PROCESS

This invention relates to aluminium casting alloys.

The alloys of the present invention possess a comprehensive range of enhanced properties and are therefore suitable for a wide variety of applications, among which may be mentioned brake calipers and drums, piston/-bore applications in internal combustion engines and a number of other components in engines, compressors and electric motors. A particular application of the alloys of the invention is in aluminium cylinder heads.

The alloys of the invention have improved properties and are characterized, in particular, by possessing:

- outstanding wear resistance, more specifically wear resistance under continued cycles of compressive loads and under conditions of sliding wear;
- high tensile and compressive strengths as well as stiffness at room temperature and at elevated temperatures up to 250° C. for short periods;
- a modulus of elasticity at room and elevated temperature which is higher than is usual for aluminium casting alloys;
- a high degree of dimensional stability; very good castability; very good machinability;
- excellent corrosion resistance;
- a coefficient of thermal expansion which is lower than normal for aluminium casting alloys.

The alloys of the invention may be used in both the as-cast and heat treated condition. While the alloys have good properties in the as-cast condition, these properties may be further improved by quite simple solution and ageing heat treatments.

The alloys of the present invention constitute a range of novel aluminium alloy compositions in which a number of known theories have been combined in a novel and unique way to give a wide range of excellent properties.

While there are a number of alloys which have some, but not all, of the abovementioned favourable properties, to our knowledge, there are none that have all of these properties in one alloy.

The British alloy BS LM13, which is used for pistons and comprises many of the elements used in the alloys of the present invention, does not have excellent high temperature strength and is not suited to applications requiring very high wear resistance. The U.S. 390 alloys, which are basically hypereutectic aluminium-silicon alloys, have been used for cylinder blocks and brake drums and possess reasonable high temperature strength and wear resistance but poor casting and machining properties. The Australian alloy 603 is a hypoeutectic aluminium-silicon alloy and is currently being used for the manufacture of the disc brake calipers. It has good machinability, castability and corrosion resistance properties but compared to the alloys of the present invention, has inferior wear resistance and strength and stiffness at elevated temperatures. Other Australian alloys (309, 313 and 601) are currently used for cylinder heads but have poor wear resistance, especially at elevated temperatures, and require inserts for valve seats and guides.

Because the alloys of the present invention possess a comprehensive range of enhanced properties, they are suitable for a wide variety of applications. These applications may require only one or a combination of the improved properties. The excellent elevated temperature strength properties and the high modulus of elasticity of the alloys of the invention are important properties for brake calipers. These properties together with the excellent wear resistance of the alloys could also make them suitable for brake drums.

The sliding wear resistance of the alloys when in contact with other hard metal surfaces may make them suitable for piston/bore applications in two and four-stroke motors, these applications also taking advantage of the alloys' good dimensional stability and low coefficient of thermal expansion. The fineness of the microstructure also prevents it from scoring or damaging surfaces softer than itself, and this is an advantage in many wearing situations with items such as soft types of seals and rotors.

The alloys of the invention could also be used for a number of other components in engines, compressors, pumps and electric motors where the excellent combination of properties including castability, machinability and corrosion resistance are major advantages.

A particular application of the alloys is in aluminium cylinder heads which normally require special steel/-bronze inserts for valve guides and valve seats. These special inserts constitute an added manufacturing cost and hence the production of alloys having improved properties, so that the need for special inserts can be minimized and hopefully avoided altogether, has great benefit.

In this respect our studies and extensive test programmes have shown that the wear of valve seats occurs by abrasion, valve rotation and continued cycles of compressive load and that sliding wear is responsible for damage to valve guides. While a knowledge of these wear mechanisms and the knowledge of properties required in other applications, was taken into careful account when designing and developing the alloys of the present invention, it should be understood that the use of the alloys is in no way limited to the applications mentioned.

Broadly, the properties of the alloys are obtained by novel alloy compositions and by careful control of the parameters of growth rate and temperature gradient at the liquid/solid interface during the solidification process. These specific compositions and solidification parameters are necessary to produce the correct microstructure which in turn is responsible for the wide range of excellent properties.

In general, the alloys of the invention have the following compositions by weight:

| | |
|---|---|
| Si | 12–15% |
| Cu | 1.5–5.5% |
| Ni | 1.0–3.0% |
| Mg | 0.1–1.0% |
| Fe | 0.1–1.0% |
| Mn | 0.1–0.8% |
| Zr | 0.01–0.1% |
| Modifier, preferably Sr | 0.001–0.1% |
| Ti | 0.01 –0.1% |
| Al | Remainder, apart from impurities. |

In a preferred embodiment the invention also provides primary alloys of the following compositions by weight:

| | |
|---|---|
| Si | 12–15% |
| Cu | 1.5–4% |
| Ni | 1.0–3.0% |

-continued

| | |
|---|---|
| Mg | 0.4–1.0% |
| Fe | 0.1–0.5% |
| Mn | 0.1–0.8% |
| Zr | 0.01–0.1% |
| Modifier, preferably Sr | 0.01–0.05% |
| Ti | 0.01–0.1% |
| Al | Remainder, apart from impurities. |

These are described in more detail in our Australian provisional specification PE 5505 filed Sept. 10, 1980.

In the following discussion and in the Examples reference is made to the accompanying figures, wherein FIG. 1 is a photomicrograph (×500) showing the cast microstructure of an alloy solidified at a growth rate of 100 $\mu ms^{-1}$ and at a G/R ratio of 9000° C. s/cm$^2$.

Figure 5:
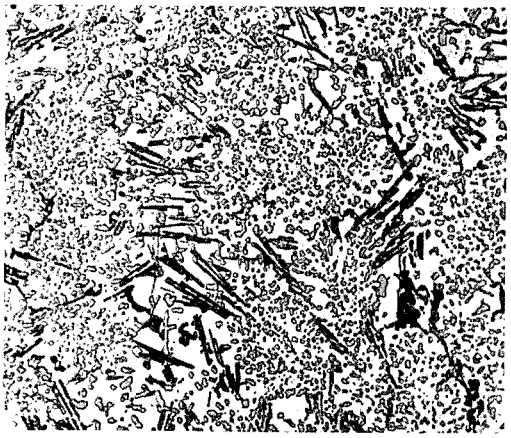

FIG. 5 is a photomicrograph (×500) showing a heat-treated microstructure, solution treated 8 hours at 470° C., aged 16 hours at 160° C. The solution treatment temperature was not sufficiently high to spheroidise all the intermetallic particles and therefore a number of excessively non-equiaxed eutectic intermetallics exist. (The growth rate was 400 $\mu ms^{-1}$ and the G/R ratio 2000 C.°s/cm$^2$).

Figure 6:
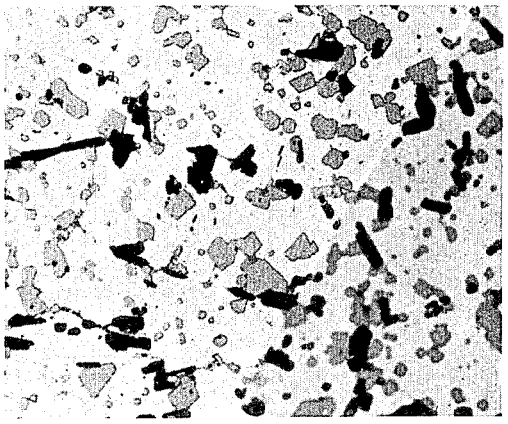

FIG. 6 is a photomicrograph (×500) showing a heat treated microstructure, solution treated 8 hours at 540° C., aged 16 hours at 160° C. The solution treatment temperature was too high causing excessive growth of the eutectic intermetallic particles. (The growth rate was 400 $\mu ms^{-1}$ and the G/R ratio 2000 C.°s/cm$^2$).

Figure 7:
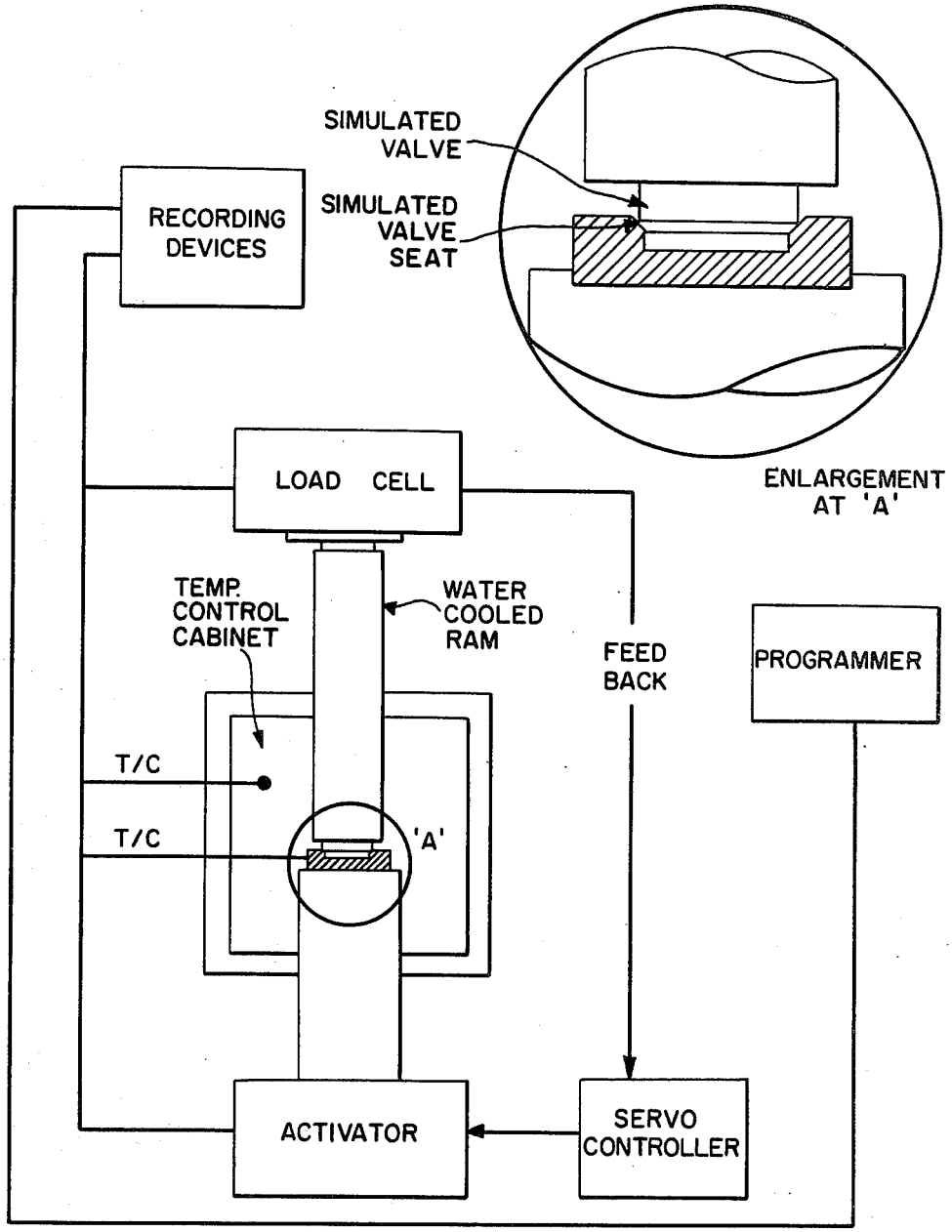

FIG. 7 is a diagrammatic representation of a simulative test rig.

Figure 8:
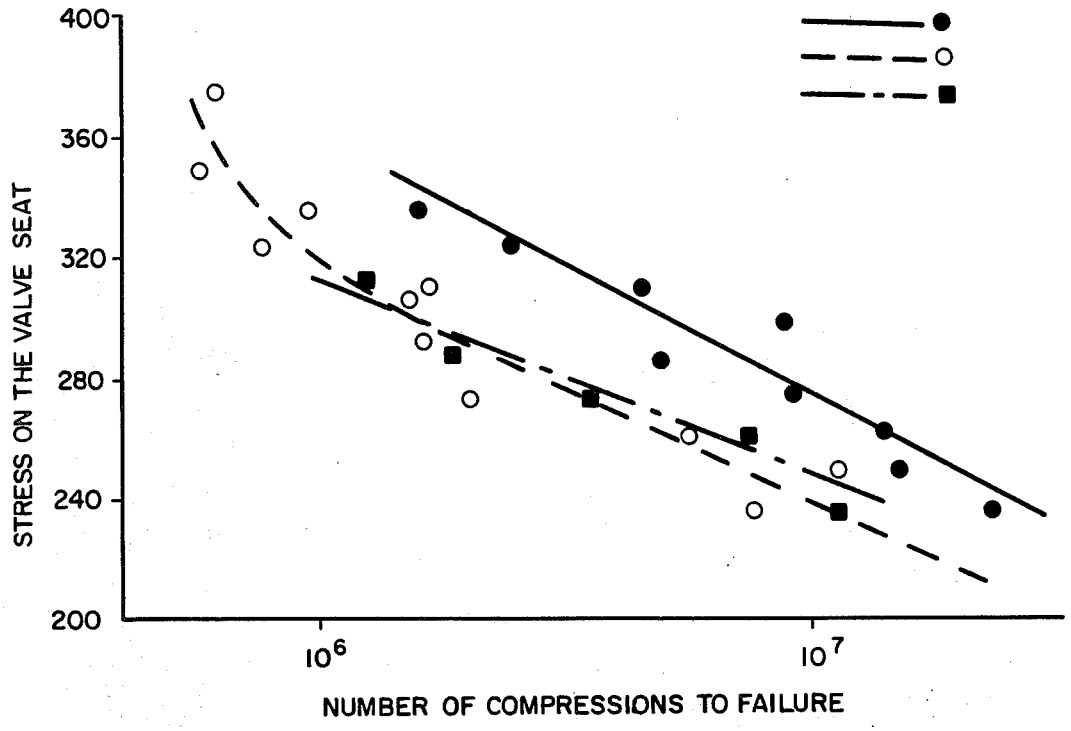

FIG. 8 shows the valve seat lives obtained as a function of applied stress in the tests described in Example 3 below.

Figure 9:
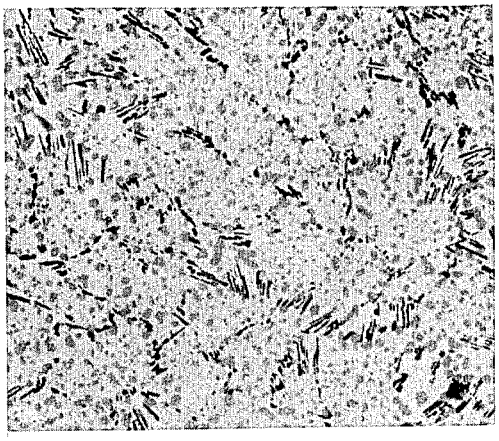

FIG. 9 is a photomicrograph (×500) showing a heat treated microstructure (solution treated 8 hours at 500° C., aged 16 hours at 160° C.). The composition of this alloy is in Table 7, Alloy No. 9. The original as-cast microstructure was produced with a growth rate of 600 $\mu ms^{-1}$ and G/R equal to 1300 C.°s/cm$^2$.×500.

Figure 10:
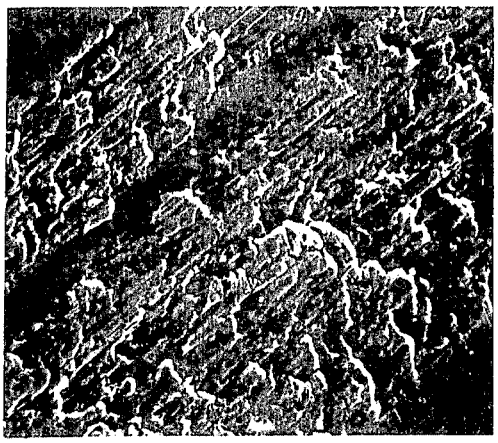
Figure 10:
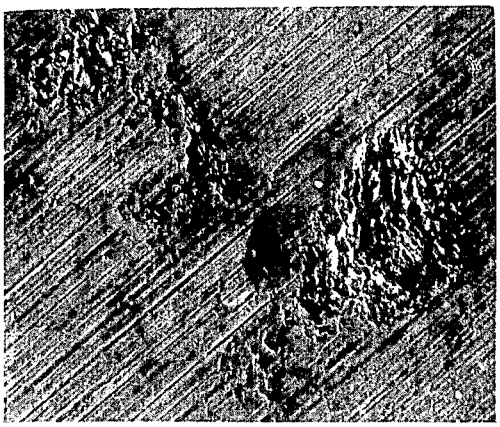
Figure 10:
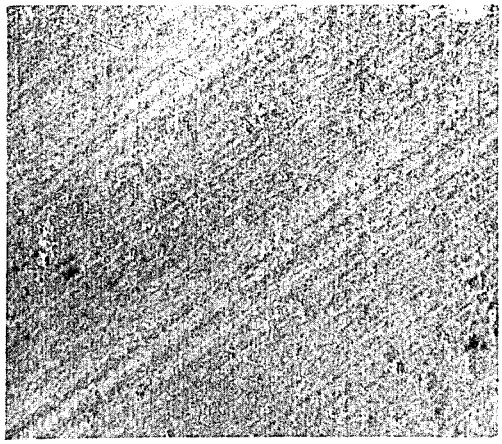

FIGS. 10 (*a*), (*b*) and (*c*) show photomicrographs (×150) comparing characteristic wear surfaces on aluminium alloys which have undergone 500 hours of sliding wear against soft seals and rotors.

Figure 11A:
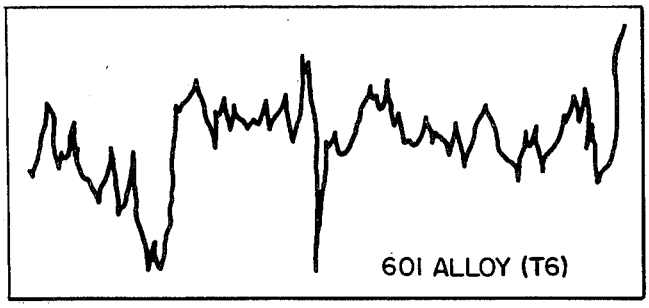
Figure 11B:
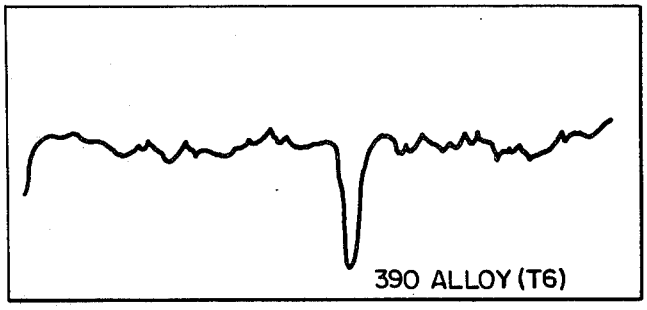
Figure 11C:
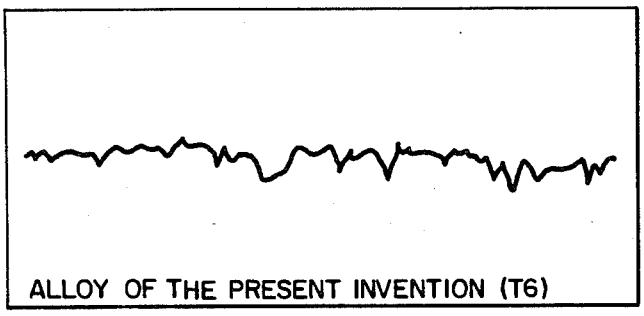

FIG. 11 shows characteristic wear surface profiles on aluminium alloys which have undergone 500 hours of sliding wear against soft seals and rotors. Horizontal Mag.=100, Vertical Mag.=1000.

Figure 12:
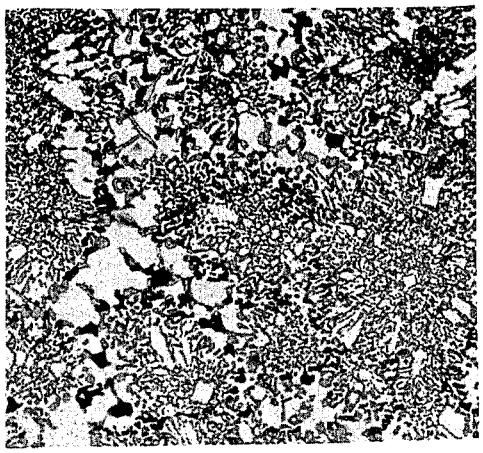

FIG. 12 is a photomicrograph (×500) of a cast microstructure of an alloy according to the invention in which the Si has been modified with sodium. The alloy was solidified at a growth rate of 700 $\mu ms^{-1}$ and a G/R ratio of 1300° C. s/cm$^2$.

The chemical composition of the alloys shown in FIGS. 1–4 was as follows by weight:

| | |
|---|---|
| Si | 14.2% |
| Fe | 0.32% |
| Cu | 2.60% |
| Mg | 0.51% |
| Zr | 0.05% |
| Ni | 2.25% |
| Mn | 0.53% |
| Ti | 0.05% |
| Sr | 0.03% |
| Al | Remainder apart from impurities. |

The chemical composition of the alloys shown in FIGS. 5 and 6 was as follows by weight:

| | |
|---|---|
| Si | 14.3% |
| Fe | 0.24% |
| Cu | 2.30% |
| Mg | 0.50% |
| Zr | 0.05% |
| Ni | 2.26% |
| Mn | 0.45% |
| Ti | 0.06% |
| Sr | 0.02% |
| Al | Remainder apart from impurities. |

Growth rate (R) is expressed in microns per second ($\mu ms^{-1}$) and temperature gradient at the interface (G) expressed in C. degrees per centimeter (C.°cm$^{-1}$). Growth rate is the growth rate of the solid during solidification of the casting. Temperature gradient is the temperature gradient existing in the liquid adjacent to the solid/liquid interface during solidification.

In order to achieve the desired properties in the alloys of the invention, the microstructure must be essentially eutectic. In practice, we have found that up to 10% of primary alpha-aluminium dendrites can be tolerated without an excessive decrease in properties. We have found that the presence of excessive amounts of alpha-aluminium dendrites results in zones of weakness in the microstructure. In addition, the presence of large primary intermetallic particles, of a size above about 10 microns in diameter can have a very detrimental effect on properties and must be avoided.

Figure 1:
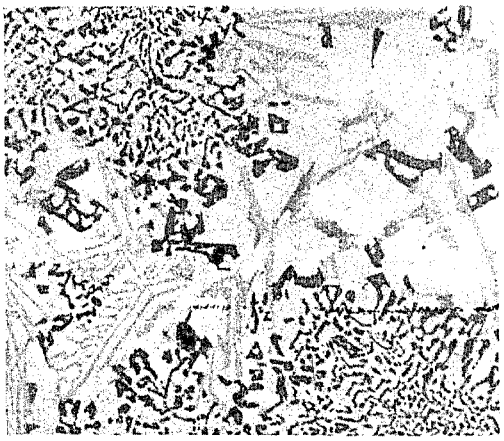
Figure 2:
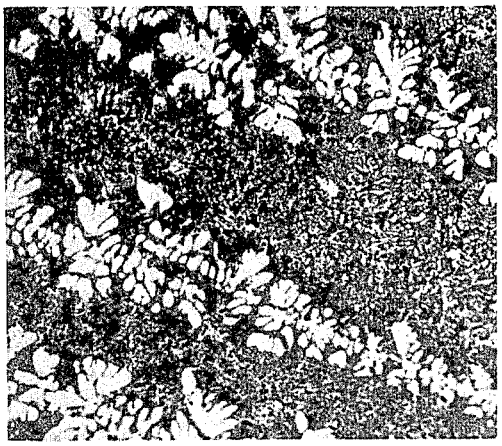
FIG. 2 is a photomicrograph (×500) showing the cast microstructure of an alloy solidified at a growth rate of 1100 $\mu ms^{-1}$ and at a G/R ratio of 450° C. s/cm$^2$.
Figure 3:
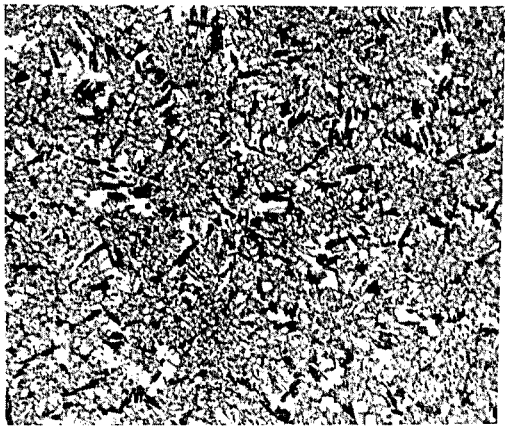
FIG. 3 is a photomicrograph (×500) showing the cast microstructure of an alloy according to the invention, solidified at a growth rate of 700 $\mu ms^{-1}$ and at a G/R ratio of 1300° C. s/cm$^2$.

Having selected an alloy composition within the specified ranges, the correct microstructure, as stated previously, depends on the choice of suitable solidification conditions. Growth rates must not be less than 150 microns per second or more than 1000 microns per second. The upper and lower limits of these rates are governed by the well established concept of "coupled growth". This concept involves the selective use of growth rates and temperature gradients which enable wholly eutectic microstructures to be produced with off-eutectic alloy compositions. Below 150 microns per second primary intermetallic particles may form and the size of the eutectic intermetallic particles might become too large (FIG. 1). Above 1000 microns per second an excess of dendrites of the aluminium rich alpha phase occurs (FIG. 2). Temperature gradients must be controlled such that the G/R ratio (temperature gradient/growth rate) is within the range of 500°–8000 C.°s/cm$^2$. With correct growth rates and G/R ratios the correct microstructure (FIG. 3) is produced.

It should be noted that in any casting of large sectional thickness all properties will vary from the surface to the interior. While this may be critical for some applications, in situations requiring wear resistance it is usually not necessary to produce the optimal microstructure right across large sectional thicknesses. Normally it will be sufficient to do so over sectional thicknesses not exceeding 2 cm, providing of course, that these include the actual working portion of the components concerned.

The composition of the alloys in the present invention requires the careful selection of alloying elements and the correct proportions of each. In most cases the effect of one element depends on others and hence there is an interdependence of the elements within the composition. In general, levels of alloying elements above the maximum specified for the alloys of the invention give rise to excessively coarse primary (as-cast) intermetallics.

In the alloys of the invention the intermetallic compounds which form part of the eutectic microstructure are based principally on the aluminium-silicon-copper-nickel system. The eutectic intermetallic particles are principally silicon but copper-nickel-aluminium, copper-iron-nickel-aluminium and other complex intermetallic phases are also present. Naturally as particle size increases so does the propensity for cracking under applied loads. For this reason the intermetallic particles comprising the eutectic must be fine (less than 10 microns in diameter), preferably uniformly dispersed and preferably with an interparticle spacing not greater than 5 microns. In order to have the desired silicon morphology and dispersion, it is essential that the silicon be in the modified form. In the abovementioned composition strontium is shown as the preferred modifier but it will be understood that the selection of any of the other known modifying elements, such as, for example, sodium, will always be well within the competence of the expert.

In addition to the eutectic intermetallic particles, the alloys of the invention comprise a dispersion of intermetallic precipitates within the alpha aluminium phase of the eutectic. Such dispersion reinforces the matrix and helps the loads to be transmitted to the eutectic particles and increases the ability for load sharing if any one eutectic particle cracks. In the present alloys we believe that the elements magnesium and copper are responsible for strengthening the matrix by precipitation hardening and/or the formation of solid solutions. Strengthening is further enhanced by the presence of stable manganese and/or zirconium containing particles. We also include these elements to improve high temperature resistance.

Copper and magnesium levels are such that suitable dispersions of precipitates can form notwithstanding that copper is inevitably present in the cast eutectic intermetallics. The copper to magnesium ratios are preferably within the limits of 3:1 to 8:1. Below this ratio unfavourable precipitates may form. Copper levels beyond the specified limits may reduce the corrosion resistance of the alloy in the applications.

Nickel, iron and manganese are particularly effective for improving elevated temperature properties and form a number of compounds with each other. These elements are interchangeable to a certain degree as shown below:

| | | | | |
|---|---|---|---|---|
| 0.2 | < | Fe + Mn | < | 1.5 |
| 1.1 | < | Fe + Ni | < | 3.0 |
| 1.2 | < | Fe + Ni + Mn | < | 4.0 |

Alloys of the invention may therefore be primary alloys with the lower Fe content or secondary alloys where the Fe levels may reach the maximum of the specification. The manganese and nickel content must be adjusted accordingly.

Titanium, because it is a well known grain refiner, is added to improve castability and to improve the mechanical properties of the alloy. Its addition in the established Ti-B form is preferred.

While the alloys of the present invention have excellent properties in the as-cast condition, the compositions are such that most properties can be improved by heat treatment. It is understood, however, that heat treatment is optional.

For example the cast alloy may be directly subjected to an artificial ageing treatment at 160°-220° C. for 2-16 hours.

Figure 4:
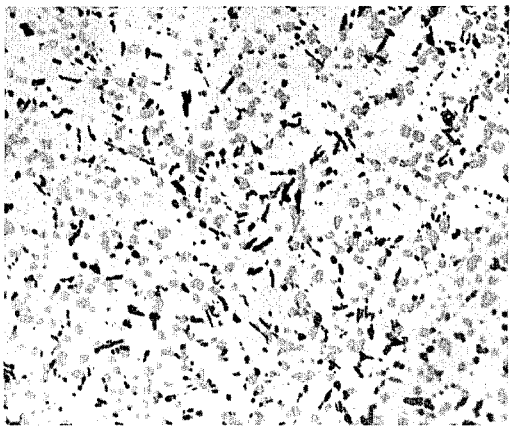
FIG. 4 is a photomicrograph (×500) showing the cast microstructure of an alloy according to the invention, solidified at a growth rate of 600 $\mu ms^{-1}$ and at a G/R ratio of 1500° C. s/cm$^2$ and heat-treated (solution treated 8 hours at 500° C. aged 16 hours at 160° C.).

A variety of other heat treatment schedules may be employed and may include solution treatment at 480°-530° C. for 5-20 hours. These solution treatments are selected to provide a suitably supersaturated solution of elements in aluminium, whilst still providing a preferred dispersion of eutectic particles i.e. a microstructure in which the eutectic particles are less than 10 microns in diameter, preferably equiaxed, preferably uniformly dispersed and preferably with an interparticle spacing not greater than 5 microns. FIG. 4 shows such a microstructure whilst FIGS. 5 and 6 show solution treatment microstructures which are not as satisfactory.

The solution treatment may be followed, after quenching, by artificial ageing at 140°-250° C. for 2-30 hours. A typical heat treatment schedule may be as follows:

8 hours at 500° C.;
quench into hot water;
artificially age at 160° C. for 16 hours.

The microstructure produced by this heat treatment is shown in FIG. 4.

The following non-limiting examples illustrate the superiority of the alloys of the invention:

EXAMPLE 1

Alloys according to the invention were prepared as cast-to-size tensile and compression samples. The samples were of the following composition:

| | |
|---|---|
| Si | 14.2 wt % |
| Fe | 0.25 wt % |
| Cu | 2.0 wt % |
| Mg | 0.5 wt % |
| Ni | 2.5 wt % |
| Mn | 0.4 wt % |
| Zr | 0.05 wt % |
| Sr | 0.01 wt % |
| Ti | 0.04 wt % |
| Al | Remainder, apart from impurities. |

and were solidified at a growth rate of approximately 200 $\mu ms^{-1}$ and G/R ratios of approximately 1300 C.°s/cm$^2$. Mechanical properties of the as-cast and heat treated samples at ambient and elevated temperatures were determined and are shown in Tables 1 and 2.

The ambient temperature ultimate tensile strength, hardness, 0.2% compressive yield strength and Young's modulus are superior to most aluminum casting alloys. We believe that the coefficient of thermal expansion and the high temperature properties are equal to the best that can be obtained with the known, highest strength aluminium alloys (Table 3).

TABLE1

| Temper | As-cast | T5 (5hrs. at) 190° C.) | T7 Solution treated for 8hrs at 520° C. quenched into hot water (>60° C.) and then aged for 5hrs. at 220° C. | T6 Solution treated for 8hrs. at 520° C. quenched into hot water (>60° C.) and then aged for 16hrs. at 160° C. |
|---|---|---|---|---|
| Ultimate Tensile Strength (MPa) | 225 | 265 | 310 | 375 |
| Hardness (BHN) | 110 | 125 | 135 | 155 |
| 0.2% Compressive Yield Strength(MPa) | 245 | 320 | 365 | 445 |
| Young's Modulus of Elasticity | $8.3 \times 10^4$ | — | — | $8.3 \times 10^4$ |
| Coeff of Thermal Expans. (mm/mm/°C. in the temp. range 20–100° C.) | $19.5 \times 10^{-6}$ | — | — | $19.0 \times 10^{-6}$ |

TABLE 2

| Testing Temp. (°C.) | Hours at Temp. | Ultimate Tensile Strength (MPa) As-Cast | I5 | T7 | T6 |
|---|---|---|---|---|---|
| 150 | 1 | 235 | 245 | 290 | 355 |
| | 1000 | 235 | 245 | 280 | 310 |
| 200 | 1 | 230 | 230 | 260 | 325 |
| | 1000 | 200 | 205 | 230 | 225 |
| 250 | 1 | 200 | 185 | 220 | 235 |
| | 1000 | 145 | 155 | 150 | 145 |

and freedom from hot shortness that the hypereutectic Al-Si alloys possess. However, the alloys of the invention do not suffer, as the hypereutectic Al-Si alloys can do, from the segregation of large primary intermetallic particles.

During the machining of hypoeutectic Al-Si alloys material generally builds up on the tool tip which reduces the quality of the surface finish. This does not occur with hypereutectic alloys but tool wear is generally very high. Neither build-up nor excessive tool wear occurs with the alloys of the present invention.

TABLE 3

| Alloy | | Alloy within the Specifications of the Present Invention (Example 1) | | 390 alloy (17.1Si—0.7Fe—4.2Cu—0.5Mg—0.08Ti) | | 603 Alloy (7.0Si—0.2Fe—0.65Mg 0.02Sr—0.03Ti) | |
|---|---|---|---|---|---|---|---|
| Temper | | As-Cast | T6 | As-Cast | T6 | As-Cast | T6 |
| Ultimate Tensile Strength (MPa) | Ambient Temp. | 225 | 375 | 210 | 360 | 170 | 305 |
| | After 1 hr. at 200° C. | 230 | 325 | 190 | 310 | 160 | 230 |
| Hardness (BHN) | | 110 | 155 | 110 | 150 | 60 | 110 |
| 0.2% Compressive Yield Stress (MPa) | | 245 | 445 | — | 420 | — | — |
| Young's Modulus of Elasticity (MPa) | | $8.3 \times 10^4$ | $8.3 \times 10^4$ | $8.2 \times 10^4$ | $8.2 \times 10^4$ | — | $7.7 \times 10^4$ |
| Coeff. of Thermal Expans. (mm/mm/°C. in the temp. range 20–100° C.). | | $19.5 \times 10^{-6}$ | $19.0 \times 10^{-6}$ | $19.0 \times 10^{-6}$ | — | — | $21.0 \times 10^{-6}$ |

EXAMPLE 2

Alloys of the invention were compared with other aluminium casting alloys in terms of dimensional stability, castability, machinability and corrosion resistance (Table 4).

The dimensional stability of the present alloys is considered better than the common hypoeutectic Al-Si alloys and similar to the excellent stability of the hypereutectic 390 alloy. After 1000 hours of service at 200° C. the dimensional change for the as-cast alloys of the present invention is less than 0.9%, for the alloys in the T6 temper is less than 0.04% and for the alloys in the T5 and T7 tempers is less than 0.02%.

The casting characteristics of the alloys of the invention are also very good and have the excellent fluidity Aluminium alloys generally have excellent corrosion resistance. This has been shown to be particularly so for the alloys of the invention in both atmospheric conditions and also in engine coolant circuit conditions. In the latter, corrosion paths have been found to follow closely the semicontinuous silicon networks. However, when the silicon particles are homogeneously dispersed, any corrosion that occurs does so uniformly rather than in a localized, damaging manner. For this reason the continuous dispersion of modified eutectic Si particles, which are present in the alloys of the invention, reduces corrosion susceptibility. Under simulated engine coolant conditions (ASTM D2570) corrosion rates were generally less than for those alloys (Australian alloys 601, 309, 313) presently used for cylinder heads and after 650 hours of service were of the order of $7\times10^{-3}$ in/year and $4\times10^{-3}$ in/year for the as-cast and heat treated (T6) alloys of the present invention, respectively.

TABLE 4

| Alloy | Dimensional Change (%)* | | Cutting Speeds m/min (Machinability)** | | Corrosion Resistance (in./yr.)*** |
|---|---|---|---|---|---|
| Temper | As-Cast | T5 | T5 | T6 | T6 |
| Alloy within spec. of the present invention (Example 1) | 0.09 | 0.02 | 400 | 400 | $4\times10^{-3}$ |
| Hypereutectic 390 Alloy | 0.08 | 0.01 | <100 | <100 | — |
| Hypoeutectic 601 Alloy | ≅0.15 | ≅0.1 | 450 | 300 | $5\times10^{-3}$ |

*Permanent dimensional change observed with samples after 1000 hours at 200° C.
**Cutting speeds in m/min which give approximately 20 minutes of tool-life in lubricated, face-milling tests.
***Corrosion rates obtained after 650 hours of testing in a simulated engine coolant test-rig (ASTM D2570 standard test).

EXAMPLE 3

A possible application for alloys with excellent wear resistance is the production of automotive cylinder heads with a reduced need for inserts in the valve seat and valve guide regions. For this application the alloy must resist both the wear at the valve seats due to abrasion, valve rotation and continued cycles of compressive loads as well as the wear at the valve guides due to a sliding nature.

In order to assess the performance of various alloys as valve seat materials, the alloys were tested under conditions approximately those believed to exist in actual practice. To this end a simulative test-rig of the type shown in FIG. 7 was used.

It is believed that plastic deformation of the valve seat area due to the combustion pressure (a cyclic compressive load) is the main cause of valve seat wear or recession. The stresses so imposed are thought to range from 25–63 MPa for the popular engine designs in use in Australia. In order to expedite comparative results these loads were increased to 262.5 MPa in the rig.

All tests were carried out at 185° C. The frequency of loading in the rig was 34 hz (=engine speed of 4100 r.p.m.), which is in the range found in a four-stroke engine. All samples tested were solution treated at 500°–525° C. for 8 hours, quenched in boiling water and then artificially aged at 180° C. for 4 hours.

The test results together with the chemical compositions, growth rates and G/R ratios are given in Table 5.

Alloys 1 and 2 in the table were also tested under dynamometer conditions; alloy 1 was found clearly unsatisfactory; alloy 2 only marginally satisfactory. Alloy 2 represents a conventional automotive alloy which is regarded as amongst the best of the commercial alloys for applications of this type. In comparison with the performance of this alloy in the simulative test-rig, the performance of the alloys of the invention (i.e. alloys 7 and 8) was very superior.

Tests were also conducted at lower loads, showing that a reduction in load of only 10% increased life by 80%. Specifically, some 26 further samples were tested to failure in the simulative test rig at a temperature of 185° C., FIG. 8 shows the valve seat lives obtained as a function of the applied stress.

Samples designated ● and ■ represent the invention with the material of the latter being in the "as cast" and of the former in the fully heat treated condition (T6 temper).

The chemical compositions were within the following limits by weight:

| | |
|---|---|
| Si | 13–15% |
| Fe | 0.3–0.4% |
| Cu | 2.0–2.2% |
| Mg | 0.4–0.6% |
| Zr | 0.04–0.06% |
| Ni | 2.0–2.5% |
| Mn | 0.4–0.5% |
| Sr | 0.03–0.05% |
| Ti | 0.05–0.07% |

Growth rates were between 300–700 $\mu ms^{-1}$ and G/R ratios were between 1000°–2000 C.°s/cm$^2$.

Samples designated o represent a conventional automotive alloy 390 as referred to in Example 1 Table 3.

This is regarded as among the best of the commercial alloys for applications of this type.

It will be seen that the performance of the alloys of the invention exceeds that of the conventional alloy.

In order to assess the performance of various alloys as valve guide materials, accelerated sliding wear tests were conducted.

These were carried out with a pin-on-disc arrangement in which an aluminium pin was rubbed, under an applied stress of 3.6 kPa, against a EN25 steel disc. The sliding speed was 3 $msec^{-1}$ and the tests were conducted dry.

The actual mechanisms of plastic deformation leading to wear in this accelerated slding wear situation were very similar to the mechanisms causing wear under the cyclic compressive situation. It was found, therefore, that the same excellent wear resistance obtained in the cyclic compressive testing for alloys of the invention was repeated in the sliding tests (Table 6). The performance of these alloys was clearly superior when compared with other alloys having reasonable sliding wear resistance.

With such superior performance in both the simulated valve seat and valve guide tests the alloys of the invention might well reduce the need for inserts in aluminium cylinder heads.

TABLE 5

| ALLOY NO. | COMPOSITION | | | | | | | | | GROWTH RATE $\mu ms^{-1}$ | APPROXIMATE G/R | VALVE SEAT LIFE AT LOAD = 262.5MPa (No. of compress- | VALVE SEAT LIFE AT LOAD = 262.5MPa (~km | |
|---|---|---|---|---|---|---|---|---|---|---|---|---|---|---|
| 1. | Si | Fe | Cu | Mg | Zr | Ni | Mn | Sr | Ti | (R) | °Cs/cm$^2$ | ions × $10^6$) | travelled) | COMMENTS |
| 2. | 12.2 | 0.51 | 2.10 | 0.41 | — | — | — | 0.03 | 0.09 | 500 | 2000 | 3.65 | 3,800 | Incorrect composition, poor performance |
| 3. | 17.1 | 0.70 | 4.20 | 0.50 | — | — | — | Trace P | 0.08 | 500 | 2000 | 5.30 | 5,800 | Incorrect composition, poor performance (Similar composition to AA 390.2) |
| 4. | 11.2 | 0.25 | 2.06 | 0.45 | 0.47 | 0.90 | 1.05 | 0.02 | 0.05 | 500 | 2000 | 4.82 | 5,100 | Composition just outside that specified in invention, poor performance |
| 5. | 11.7 | 0.28 | 2.28 | 0.20 | 0.20 | 1.00 | 1.10 | 0.02 | 0.05 | 400 | 2500 | 5.18 | 5,500 | Composition just outside that specified in invention, poor performance |
| | 14.3 | 0.25 | 2.60 | 0.47 | 0.05 | 2.45 | 0.47 | 0.03 | 0.07 | 100 | 4500 | 7.20 | 7,600 | Correct composition, R too small, large intermetallics present, better performance |
| 6. | 13.0 | 0.30 | 2.78 | 0.48 | 0.05 | 2.30 | 0.46 | 0.02 | 0.08 | 1500 | 1000 | 7.70 | 8,200 | Correct composition, R too large, many $\alpha$ - dendrites present, better performance |
| 7. | 15.0 | 0.30 | 2.68 | 0.51 | 0.05 | 2.25 | 0.51 | 0.03 | 0.08 | 900 | 1500 | 14.8 | 15,700 | In accordance with specification in all respects, good performance |
| 8. | 12.7 | 0.26 | 2.45 | 0.55 | 0.05 | 2.30 | 0.47 | 0.03 | 0.06 | 400 | 2500 | 14.0 | 14,900 | In accordance with specification in all respects, good performance |

TABLE 6

| Alloy No* | Temper | As-Cast Microstructure | Average Sliding Distance Prior to any Wear being Detected (cm × $10^5$) | Average Sliding Distance at which the Alloy Pin has Recessed 0. 1mm (cm × $10^5$) |
|---|---|---|---|---|
| 1 | T5** | α-Dendrites | 7.1 | 7.4 |
| | T6 | | 8.0 | 12.7 |
| 2 | T5*** | Primary | 1.2 | 7.3 |
| | T6 | Intermetallics | 5.4 | 12.5 |
| 7 | As-Cast | Fully | 7.4 | 11.4 |
| | T6 | Eutectic | 9.6 | 17.6 |

*Alloy No. refers to the same Alloy Nos in Table 5.
**Aged 4hrs. at 180° C.
***Aged 6hrs at 200° C.

EXAMPLE 4

Alloys of different compositions but conforming to the specifications of the invention were also tested in the simulative test rig (compressive loading) under the same temperature and frequency conditions as for Example 3 and at a load of 262.5 MPa. The test results are given in Table 7.

An alloy composition within the preferred composition range provided the best wear resistance while compositions outside this preferred composition range but within the specification of the invention gave lesser wear resistance but levels which were still significantly superior to other alloys.

The microstructure of an alloy within the broad specifications of the invention is shown in FIG. 9. This alloy conforms to the preferred composition of the invention in all aspects except for the high Fe content (0.55 wt.%). The microstructure of this alloy is a result of specific solidification conditions (G equal to 600 $\mu ms^{-1}$ and G/R equal to 1300 C.°s/cm$^2$) and heat treatment conditions (solution treated 8 hours at 500° C., aged 16 hours at 160° C.). Naturally with the different solidification and heat treatment conditions as allowed within the specification of the invention, slightly different microstructures for this alloy can be obtained.

EXAMPLE 5

Another possible application for alloys having excellent wear characteristics is in many types of compressor units where the aluminium is in rubbing contact with soft types of seals and rotors and both mating surfaces need to remain as smooth as possible. Testing has been carried out to assess the performance of various aluminium alloys in this application.

Examples of the surface roughness of aluminium alloys after prolonged periods of testing in this application are shown in FIGS. 10 and 11. The results shown are for three alloys:

(a) a hypoeutectic alloy CP 601 (Table 4) of good strength and hardness with a composition of: 7.0 Si, 0.2 Fe, 0.35 Mg, 0.02 Sr, and 0.03 Ti (FIGS. 10(*a*) and 11(*a*).

(b) the high strength, hypereutectic Al-Si alloy, 390, (see Example 1) commonly used for wear resistant applications (FIGS. 10(*b*) and 11(*b*)).

(c) an alloy of the present invention having a composition the same as that given in Example 1 and whose wear surface structure approximated to that achieved with a growth rate of approximately 400 $\mu ms^{-1}$ and a G/R ratio of approximately 2500 C.°s/cm$^2$ (FIGS. 10(*c*) and 11(*c*)).

It is very evident, that with prolonged testing, the aluminium matrix in the hypoeutectic alloy (containing α-dendrites) was deformed and small amounts ulti-

TABLE 7

| Alloy No. | Composition Si | Fe | Cu | Mg | Zr | Ni | Mn | Sr | Ti | Growth Rate $\mu ms^{-1}$ (R) | Approximate G/R (°Cs/cm$^2$) | Valve Seat Life at Load = 262.5MPa No. of Compressions × $10^6$ | Valve Seat Life at Load = 262.5MPa (~km travelled) | Comments |
|---|---|---|---|---|---|---|---|---|---|---|---|---|---|---|
| 7* | 15.0 | 0.30 | 2.68 | 0.51 | 0.05 | 2.25 | 0.51 | 0.03 | 0.08 | 900 | 1500 | 14.8 | 15,700 | In accordance with the preferred composition. Best performance. |
| 9 | 15.0 | 0.55 | 2.62 | 0.48 | 0.05 | 2.40 | 0.47 | 0.02 | 0.07 | 900 | 1500 | 12.8 | 13,600 | In accordance |
| 10 | 13.5 | 0.29 | 1.95 | 0.35 | 0.06 | 2.20 | 0.70 | 0.02 | 0.08 | 900 | 1500 | 11.2 | 11.900 | In accordance with the specification but not a preferred composition. Performance better than alloys outside the specification. |

*Alloy No. 7 the same as that specified in Example 3, Table 5.

mately removed from the surface. This wear "debris" then acted as an abrasive medium to produce further wear of the two contacting surfaces. With the hypereutectic alloy, the large primary intermetallics in this structure directly abraded the softer material. Microcracks also initiated in and near the large intermetallics which resulted in detachment of metal. The fully eutectic alloys of the present invention, however, were very resistant to any form of delamination and did not damage the softer, contacting surface—in fact a polishing action was obtained.

EXAMPLE 6

The Si particles in the alloys of the invention can be modified by elements other than strontium and in this example sodium is shown to be a suitable modifier. In FIG. 12, a microstructure is shown which was obtained by solidifying at a growth rate of 700 $\mu ms^{-1}$ and a G/R ratio of 1300 C.°s/cm$^2$ and the composition of which was:

| | |
|---|---|
| Si | 14.0 wt % |
| Cu | 2.2 wt % |
| Ni | 2.1 wt % |
| Mg | 0.45 wt % |
| Fe | 0.30 wt % |
| Mn | 0.45 wt % |
| Zr | 0.05 wt % |
| Na | ≅0.01 wt % |
| Ti | 0.05 wt % |
| Al | Remainder, apart from impurities |

I claim:

1. An aluminium-silicon alloy consisting essentially of the following composition by weight:

| | |
|---|---|
| Si | 12–15% |
| Cu | 1.5–5.5% |
| Ni | 1.0–3.0% |
| Mg | 0.1–1.0% |
| Fe | 0.1–1.0% |
| Mn | 0.1–0.8% |
| Zr | 0.01–0.1% |
| Silicon modifier | 0.001–0.1% |
| Ti | 0.01–0.1% |
| Al | remainder, apart from impurities, |

said alloy having an essentially eutectic microstructure containing not more than 10% of primary alpha-aluminium dendrites and being substantially free from intermetallic particles exceeding 10 microns in diameter.

2. An aluminium-silicon alloy consisting essentially of the following composition by weight:

| | |
|---|---|
| Si | 12–15% |
| Cu | 1.5–4% |
| Ni | 1.0–3.0% |
| Mg | 0.4–1.0% |
| Fe | 0.1–0.5% |
| Mn | 0.1–0.8% |
| Zr | 0.01–0.1% |
| Silicon modifier | 0.01–0.05% |

-continued

| | |
|---|---|
| Ti | 0.01–0.1% |
| Al | remainder, apart from impurities, |

said alloy having an essentially eutectic microstructure containing not more than 10% of primary alpha-aluminium dendrites and being substantially free from intermetallic particles exceeding 10 microns in diameter.

3. An alloy of the composition defined in claim 1, prepared by establishing a melt of the said composition and allowing it to solidify under conditions such that the growth rate R of the solid phase during solidification is from 150 to 1000 microns per second and the temperature gradient G at the solid/liquid interface, expressed in °C./cm, is such that the ratio G/R is from 500 to 8000 C.°s/cm$^2$.

4. An alloy of the composition defined in claim 2, prepared by establishing a melt of the said composition and allowing it to solidify under conditions such that the growth rate R of the solid phase during solidification is from 150 to 1000 microns per second and the temperature gradient G at the solid/liquid interface, expressed in °C./cm, is such that the ratio G/R is from 500 to 8000 C.s/cm$^2$.

5. A process for preparing an aluminium-silicon alloy according to claim 1 said process comprising establishing a melt of the said composition and allowing it to solidify under conditions such that the growth rate R of the solid phase during solidification is from 150 to 1000 microns per second and the temperature gradient G at the solid/liquid interface, expressed in °C./cm, is such that the ratio G/R is from 500 to 8000 C°s/cm$^2$.

6. A process according to claim 5 comprising the further step of subjecting said alloy to an artificial ageing treatment at 160°–220° C. for 2–16 hours.

7. A process according to claim 5 comprising the further step of subjecting said alloy to a heat treatment schedule including solution treatment at 480°–530° C. for 5 to 20 hours, quenching into hot water, and artificial ageing at 140° to 250° C. for 2 to 30 hours.

8. A process for preparing an aluminium-silicon alloy according to claim 5 said process comprising establishing a melt of the said composition and allowing it to solidify under conditions such that the growth rate R of the solid phase during solidification is from 150 to 1000 microns per second and the temperature gradient G at the solid/liquid interface, expressed in °C./cm, is such that the ratio G/R is from 500 to 8000 C.°s/cm$^2$.

9. A process according to claim 8 comprising the further step of subjecting said alloy to an artificial ageing treatment at 160°–220° C. for 2–16 hours.

10. A process according to claim 8 comprising the further step of subjecting said alloy to a heat treatment schedule including solution treatment at 480°–530° C. for 5 to 20 hours, quenching into hot water, and artificial ageing at 140° to 250° C. for 2 to 30 hours.

11. An aluminum-silicon alloy according to claim 1 or claim 2 wherein said modifier comprises Sr.

12. An aluminium-silicon alloy according to claim 1 or 2 wherein said modifier comprises sodium.

* * * * *